United States Patent [19]

Mills

[11] Patent Number: 4,774,734

[45] Date of Patent: Oct. 4, 1988

[54] CONVERTIBLE SLEEPING BAG AND STUFFED TOY

[76] Inventor: Carol B. Mills, 6830 Trexler Rd., Lanham, Md. 20706

[21] Appl. No.: 65,112

[22] Filed: Jun. 23, 1987

Related U.S. Application Data

[63] Continuation of Ser. No. 685,614, Dec. 28, 1984, abandoned, which is a continuation of Ser. No. 429,638, Sep. 30, 1982, abandoned, which is a continuation-in-part of Ser. No. 395,375, Jul. 6, 1982, abandoned.

[51] Int. Cl.[4] ..... A47C 23/00

[52] U.S. Cl. ..... 5/413; 446/72; 446/73; 2/69.5; 224/156

[58] Field of Search ..... 5/413, 419, 42 B, 44 B, 5/417; 2/69.5, 84–86, 94; 224/151–156; 446/72, 73, 369–374

[56] References Cited

U.S. PATENT DOCUMENTS

| | | | |
|---|---|---|---|
| 41,870 | 3/1864 | Süs | 224/156 |
| D. 256,202 | 8/1980 | Schmickel et al. . | |
| 261,464 | 10/1981 | Smith | 5/419 |
| 748,288 | 12/1903 | Klein . | |
| 1,575,263 | 3/1926 | Guglielmi . | |
| 1,930,942 | 10/1933 | Pringle | 5/419 |
| 2,183,418 | 7/1939 | Williams . | |
| 2,315,126 | 3/1943 | Michalke, Nee Parnow . | |
| 2,376,617 | 3/1944 | O'Reilley . | |
| 2,428,795 | 10/1947 | Frazee . | |
| 2,791,775 | 4/1955 | Sartell . | |
| 2,883,682 | 4/1959 | Kwake | 5/419 |
| 2,971,205 | 2/1961 | Shultz . | |
| 3,176,315 | 4/1965 | Freund . | |
| 3,477,552 | 8/1967 | Goldman . | |
| 3,774,249 | 11/1973 | Ybarra et al. . | |
| 3,848,267 | 11/1974 | De Spain | 224/151 |
| 3,878,574 | 4/1975 | Erickson | 5/413 |
| 4,103,377 | 8/1978 | Mayer et al. . | |
| 4,164,275 | 8/1979 | Davis | 5/417 |
| 4,236,263 | 12/1980 | Allee | 5/413 |
| 4,316,287 | 2/1982 | Rule | 2/69.5 |
| 4,375,111 | 3/1983 | Hall | 5/419 |
| 4,404,687 | 9/1983 | Hager | 2/94 |
| 4,404,689 | 9/1983 | DeWan | 2/247 |

FOREIGN PATENT DOCUMENTS

| | | | |
|---|---|---|---|
| 2493123 | 5/1982 | France | 5/413 |
| 2061712 | 5/1981 | United Kingdom | 190/2 |

OTHER PUBLICATIONS

*The Washington Post Magazine,* Jun. 13, 1982, p. 55, excerpt showing an article entitled "Try It! Turns Out To Be A Butterfly.".

*Primary Examiner*—Gary L. Smith
*Assistant Examiner*—Vinh Luong
*Attorney, Agent, or Firm*—Dowell & Dowell

[57] ABSTRACT

A sleeping bag having a pocket or pouch located on an exterior surface thereof which may be in the configuration of an animate or inanimate object, and which is of sufficient size to receive the sleeping bag therein as the pocket is pulled inside out so that the interior surfaces of the pocket form the external surfaces of a stuffed child's toy which toy is a three dimensional likeness of the configuration or shape of the pocket or pouch. In another embodiment, the sleeping bag is recieved within the pouch to form a simulated knapsack which can be carried by a child and which may be used to receive other articles.

7 Claims, 3 Drawing Sheets

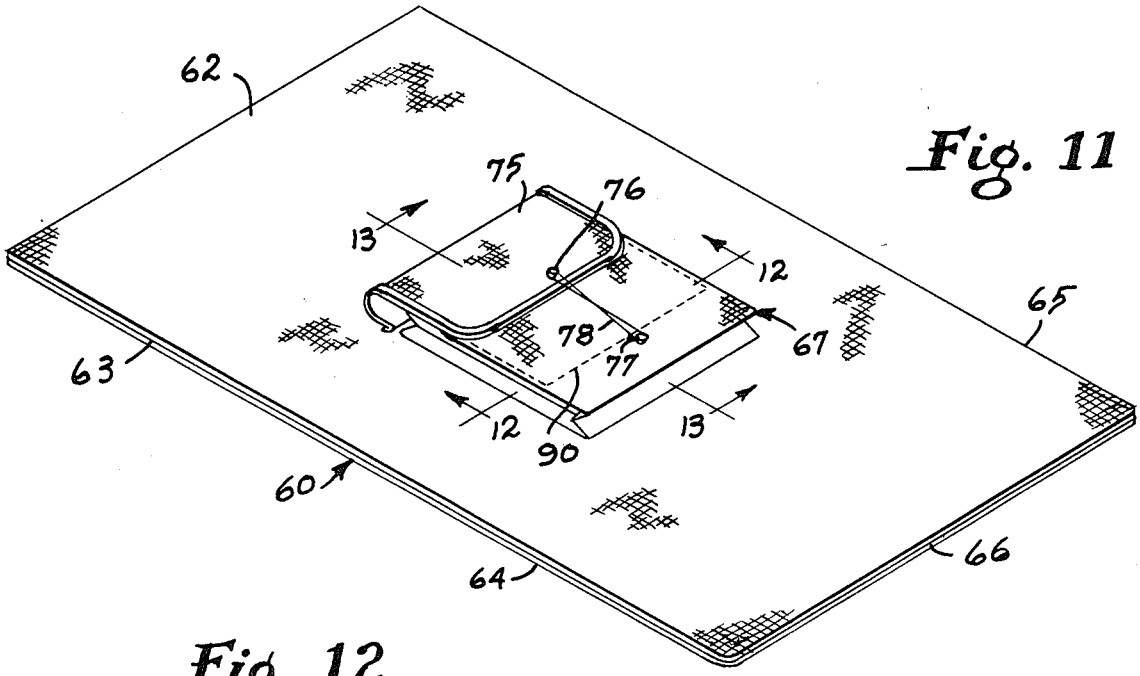
Fig. 11
Fig. 12
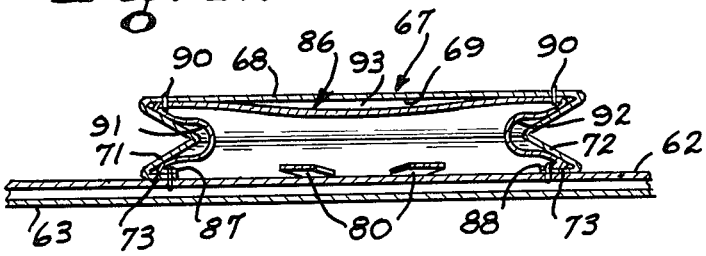
Fig. 13
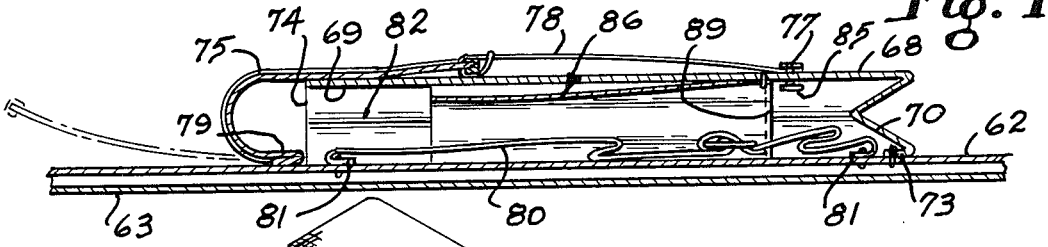
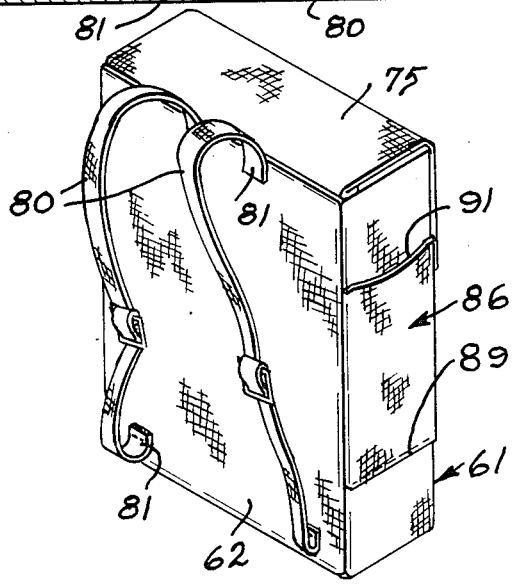
Fig. 14

CONVERTIBLE SLEEPING BAG AND STUFFED TOY

CROSS REFERENCED TO RELATED APPLICATION

This application is a continuation, of application Ser. No. 685,614, filed Dec. 28, 1984, which is a continuation application of Ser. No. 429,638 filed Sept. 30, 1982, which is a continuation-in-part of Ser. No. 395,375 filed July 6, 1982 all now abandoned.

BACKGROUND OF THE INVENTION

1. Field of the Invention

This invention is generally related to bedding equipment of the sleeping bag type and particularly to a sleeping bag which is particularly adapted and designed for use by children which sleeping bag may be selectively converted into a child's play toy in which the main body of the sleeping bag functions as the stuffing for the toy. In a secondary embodiment, the toy may serve as a simulated knapsack in which various articles may selectively be carried.

2. History of the Prior Art

The use of sleeping bags is becoming increasingly popular with children both for home use, travel, and for overnight visits with friends and family. Current manufacturers of children's sleeping bags have made use of familiar toy and cartoon characters which are brightly displayed or printed on the cover or surface of the sleeping bags to both attract attention and to make the sleeping bags more endearing to children.

In addition to the foregoing, some children's sleeping bags have also been designed to actually simulate or partially simulate the shape of an animal or other creature to make them more appealing. Examples of simulated shapes for sleeping bags include a fish, as disclosed in United States Design Patent No. 255,202; and an alligator, as disclosed in U.S. Pat. No. 4,236,263.

Structurally, however, the sleeping bags currently available for children do not differ substantially from conventional sleeping bags and thus such bags must be folded or rolled up when not in use and stored in a closet or some other area. Therefore, most sleeping bags offer utility only as a bedding item and have the disadvantage that they require additional storage space be set aside so that the rolled bags can be stored out of sight.

Other attempts have been made to make sleeping bags, blankets or coverlets more appealing to children by providing toy characteristics in combination with the blanket or bag. In U.S. Pat. No. 1,575,263, a doll is sewn to a blanket and serves not only as an ornamental object thereon, but the patent teaches that the blanket may be rolled up and tied behind the doll image to create a more realistic toy configuration. However, the blanket remains visible to the observer and thus the resultant doll resembles a rolled blanket having a figure attached thereto.

The idea of creating sleeping bags and similar items which may be convertible to other objects is generally known and some examples include a convertible beach blanket and robe, U.S. Pat. No. 3,176,315; sleeping bag and jacket, U.S. Pat. No. 2,376,617; mat and tote bag, U.S. Pat. No. 3,477,552 coverlet and pillow, U.S. Pat. No. 2,183,418; and combined robe and bag, U.S. Pat. No. 2,791,775. None of the foregoing patents, however, provide structures having the capability and utility of both appealing to children as a sleeping bag and as a stuffed toy. Further, the foregoing patents do not suggest providing a sleeping bag for children having an ornamental and useful pocket placed on the surface thereof when the sleeping bag is in use and which sleeping bag can be selectively converted into a stuffed toy simulating the ornamental features of the pocket when the sleeping bag is stored away within the pocket.

SUMMARY OF THE INVENTION

This invention is directed to a sleeping bag which may be selectively converted into a child's pillow or toy. The sleeping bag includes an enlarged pocket or pouch attached to the surface thereof and which is open at one end to permit placement of articles therein. The pocket is of sufficient size to permit the sleeping bag to be pulled therethrough so that as the pocket is turned inside out, the inner surfaces of the pocket become the outer surfaces of a toy which envelope the entire sleeping bag therein. Thereby, the toy becomes a three dimensional object resembling the shape of the enlarged pocket which is attached to the sleeping bag. Closure means may also be provided along the open edge portion of the pocket so that the sleeping bag may be secured within the pocket. In a secondary embodiment, the stuffed toy may be shaped to simulate a knapsack. The knapsack may be carried by the user and may also be of sufficient size to store other articles.

It is the primary object of this invention to provide a sleeping bag which is particularly adapted and designed for use by children which sleeping bag can be selectively converted into a child's pillow or stuffed toy when in a stored condition.

It is another object of this invention to provide a convertible sleeping bag for children wherein the sleeping bag not only functions as bedding equipment for use by children, but which can be selectively used as a child's plaything or toy.

It is another object of the invention to provide a sleeping bag with a storage pocket or pouch which may be used to receive various personal articles when the sleeping bag is in use and in which the pocket can be turned inside out to receive the remainder of the sleeping bag therein so that the inner surfaces of the pocket form the outer surfaces of a shaped object which contains the sleeping bag when the sleeping bag is not in use.

It is yet another object of this invention to provide a child's stuffed toy which may be selectively converted to a sleeping bag having a pocket or pouch connected thereto which pocket represents a planar image of the stuffed toy.

It is a further object of the invention to provide a child's sleeping bag which may be easily and quickly converted into a child's toy for transportation, storage and play.

It is also an object of this invention to provide a child's sleeping bag which may be easily converted into a toy simulating a knapsack in which the knapsack may be selectively used to carry other articles.

BRIEF DESCRIPTION OF THE DRAWINGS

FIG. 11 is a reduced illustrated view of a second embodiment of the invention.

FIG. 12 is a sectional view taken along lines 12—12 of FIG. 11.

FIG. 13 is a sectional view taken along lines 13—13 of FIG. 11.

FIG. 14 is an illustration of the second embodiment in the form of a toy knapsack.

DESCRIPTION OF THE PREFERRED EMBODIMENT

Figure 1:
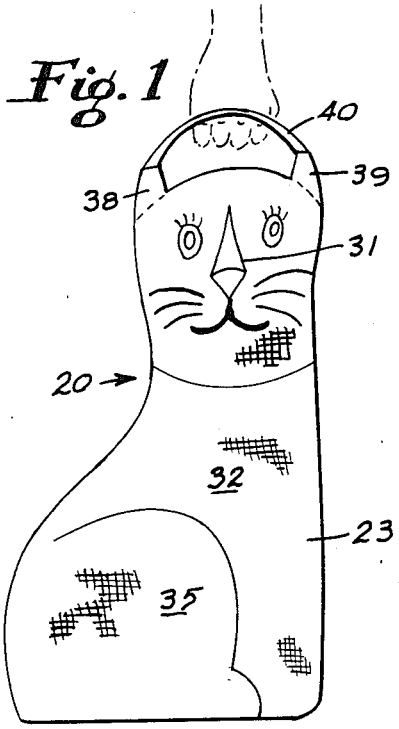
FIG. 1 is a front view of the invention in the form of a stuffed toy.
Figure 2:
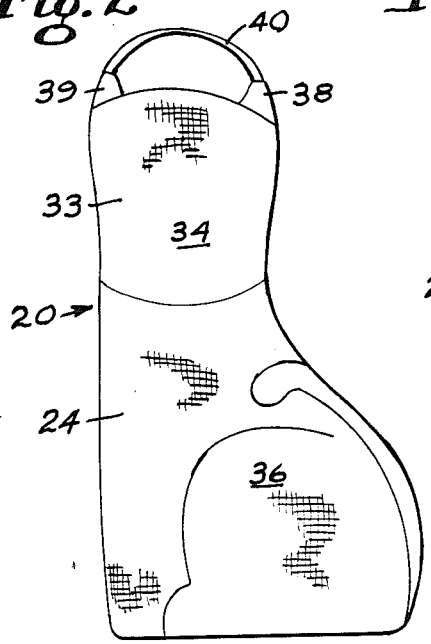
FIG. 2 is a rear view of the invention shown in FIG. 1.
Figure 3:
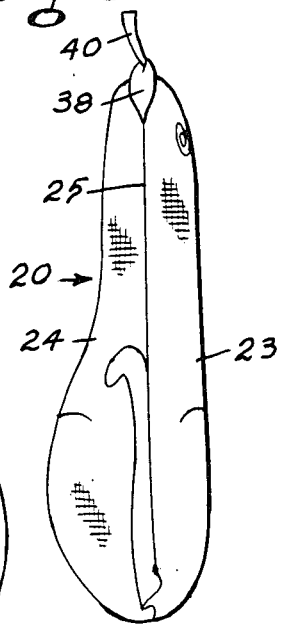
FIG. 3 is a right side elevational view of the invention shown in FIG. 1.
Figure 4:
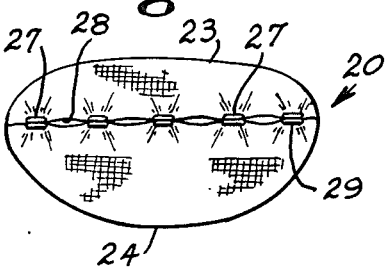
FIG. 4 is a bottom plan view of the invention shown in FIG. 1.
Figure 5:
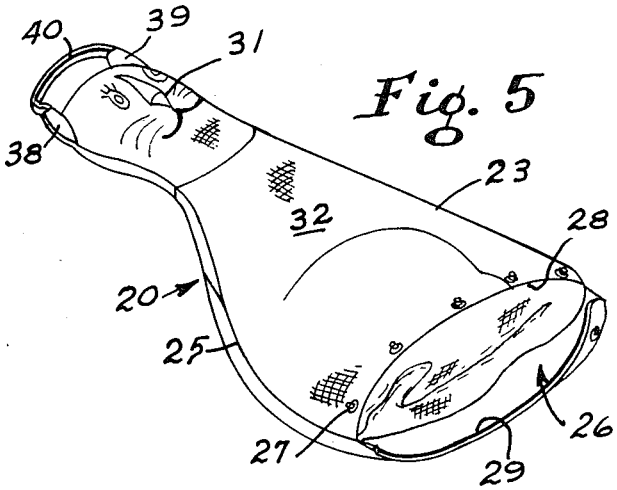
FIGS. 5–7 are step-by-step illustrations showing the sleeping bag portion of the invention being pulled from within the stuffed toy of FIG. 1.
Figure 6:
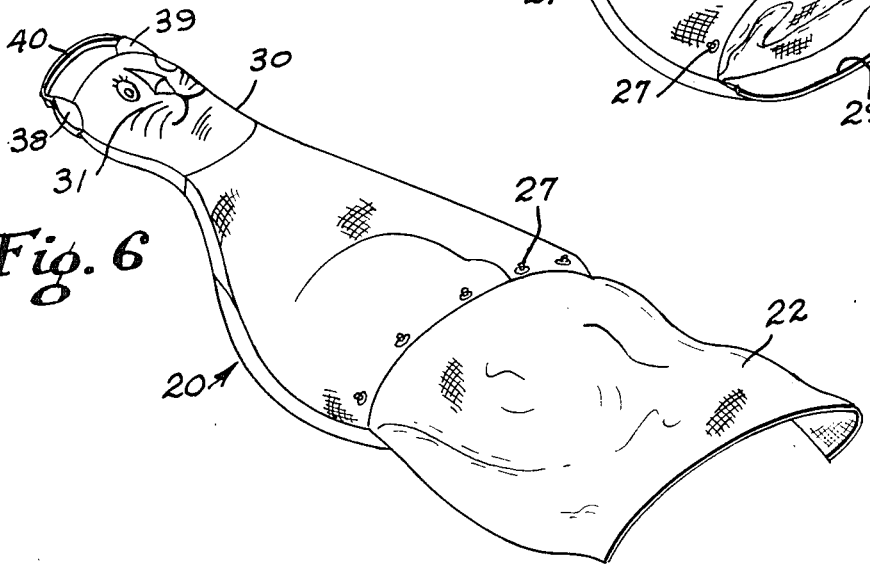
Figure 7:
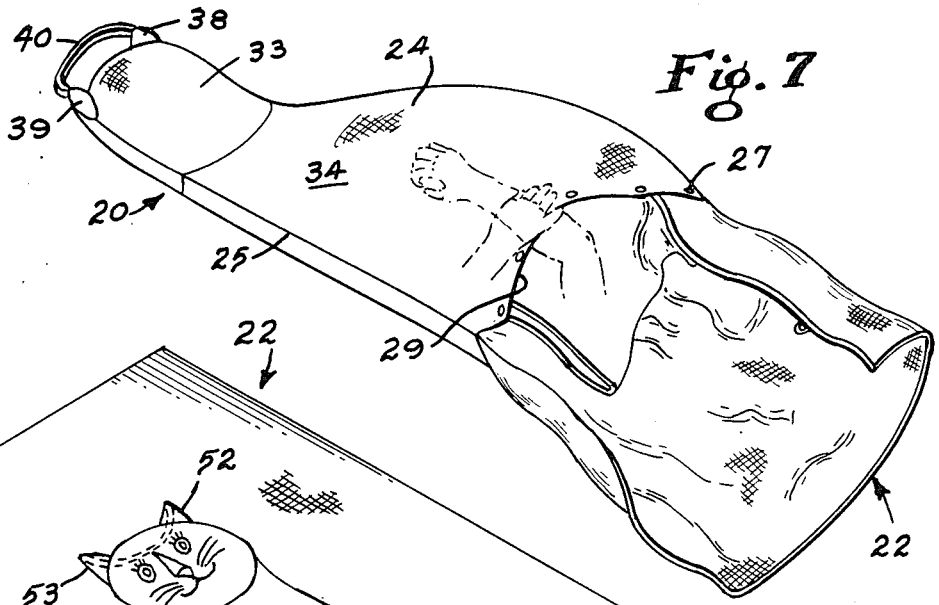
Figure 8:
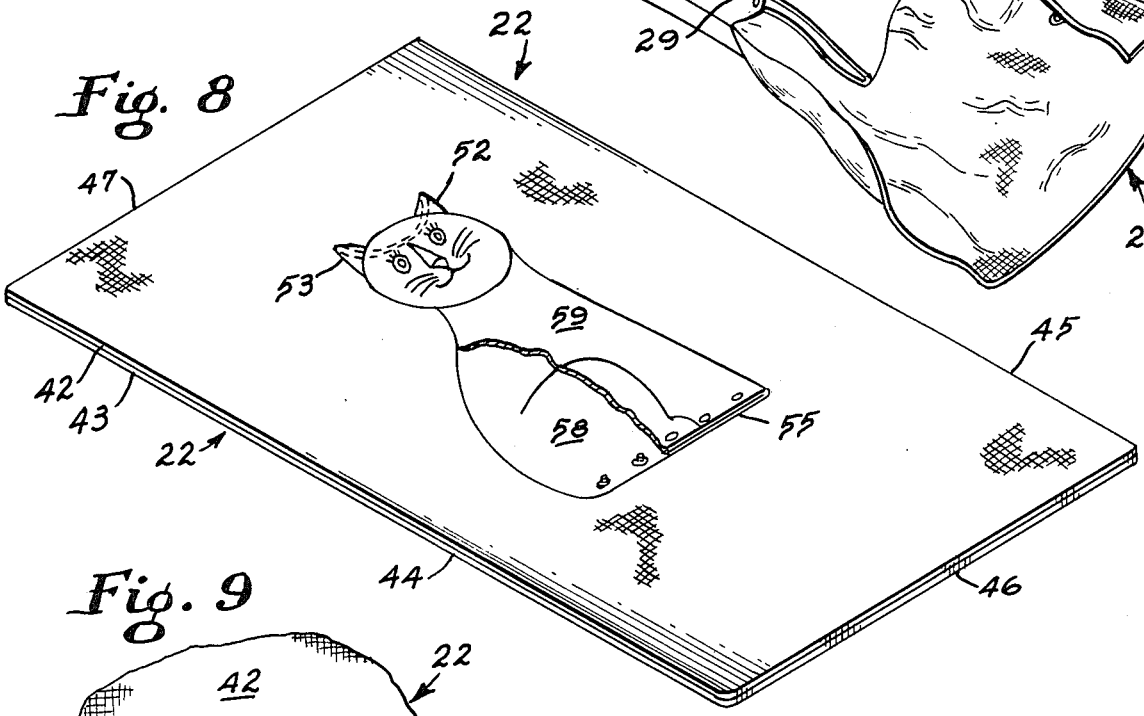
FIG. 8 is a reduced illustration of the sleeping bag showing portions of the animal shaped pocket or pouch broken away.

With particular reference to FIGS. 1 and 8 of the drawings, the present invention is shown as having utility both as a child's stuffed play toy 20 and as a sleeping bag 22. In this regard, the convertible sleeping bag is particularly suitable for use by children. As shown in the drawings, the stuffed toy is in the configuration of a cat, however, any character or animal like configuration could be appropriately utilized, it being recognized that it is the primary concern to stimulate or appeal to a child's interest. Thus any number of different stuffed toy shapes and designs could be used in the practice of the present invention. Additionally, the stuffed toys need not be limited to character or animal shapes, but could be designed and constructed to resemble inanimate objects such as a spacecraft, a rocket, a football or the like. Likewise, the shape of the toy could be made in a geometrical form such as a sphere with appropriate figures or pictures printed thereon.

Preferably, however, the stuffed toy is in the configuration of a character or animal which will attract children's attention and includes overlying front and rear panels 23 and 24 which are joined along their top and side edges by stitching 25 so as to form a cavity 26 therebetween. The panels may be constructed of a single piece of material having an image printed thereon, or may be constructed of a plurality of separate smaller pieces of material which are joined in a patchwork quilt like manner to resemble the object being depicted. A plurality of selectively engageable fastening members such as friction locking snaps 27 are provided along the lower edges 28 and 29 of the front and rear panels 23 and 24 so as to provide a selectively operable closure mechanism for joining the lower edges together to completely enclose and retain the sleeping bag 22 within the cavity 26 when the sleeping bag is in the stored position functioning as the stuffing for the toy. It should be understood that other suitable fastening means such as a zipper could be used in place of the snaps 27.

When the sleeping bag 22 is retained within the cavity 26 formed between the front and rear panels of the toy 20, the toy has three dimensional characteristics and includes a head 30 having a face 31 printed or otherwise created on the outer surface 32 of the front panel with the rear of the head 33 created on the outer surface 34 of the rear panel. The toy further includes a designed front body portion 35 created on the front panel and a simulated back body portion 36 created on the rear panel. In the arrangement disclosed in the drawings, the stuffed toy also includes a pair of spaced ears 38 and 39 which are connected adjacent their ends by a flexible strap or handle 40. The strap or handle 40 has utility in providing means by which the toy may be hand carried or toted, but the handle is provided more specially to assist in stuffing the toy with the sleeping bag as will be described in greater detail hereinafter.

With particular reference to FIG. 8, the invention is illustrated as it is opened and expanded to form a sleeping bag 22 which is preferably of a reduced size such as those currently marketed for young children. The sleeping bag includes top and bottom panels 42 and 43 which are joined along the sides 44 and 45 and one end 46. The upper end 47 of the sleeping bag is open so as to permit entry into the sleeping bag between the top and bottom panels 42 and 43. If desired, a zipper or other suitable fastening means may be provided along one or both of the sides and the closed end portion of the sleeping bag to permit the top and bottom panels to be partially separated from one another or to permit the sleeping bag to be opened to provide an expanded blanket like configuration. In construction, the sleeping bag may be manufactured using a poplin cover material having a lining between which a polyester batting is provided, although any other suitable and/or conventional material and padding or batting may be used.

Although the preferred embodiment of the invention is directed to a toy and sleeping bag combination, it should be noted that the sleeping bag need not be of conventional configuration, but may be in the form of a blanket or sleeping pad, and may be of any desired shape such as rectangular, oblong, or simulative of any object, character or other design. In this regard, younger school aged children in nursery or preschool are frequently requested to bring a pad or rug to school for purposes of taking short naps or breaks. The invention is equally applicable to a convertible child's blanket or rug and a toy. In such instances, the sleeping bag would be constructed of a single thickness or material as opposed to the traditional sleeping bag configuration.

Figure 9:
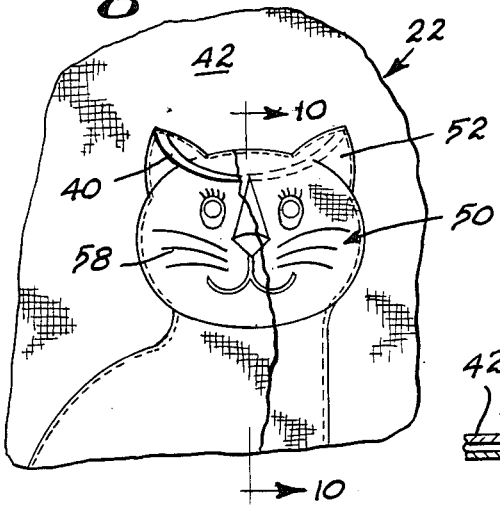
FIG. 9 is an enlarged partial top plan view of the animal shaped pocket of FIG. 8 with portions broken away to show the interior design of the pocket.
Figure 10:
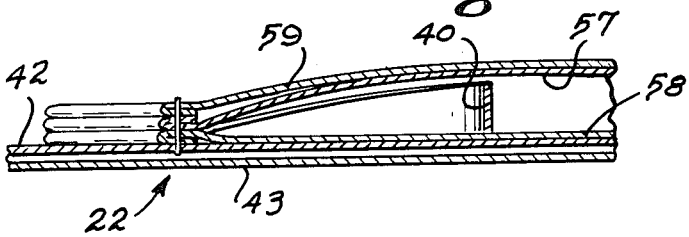
FIG. 10 is a section taken along lines 10—10 of FIG. 9.

With continued reference to FIG. 8 and additional reference to FIGS. 9 and 10, the upper surface or top panel 42 of the sleeping bag has an enlarged pocket or pouch 50 attached thereto by stitching or other suitable fastening means. In the embodiment shown, the pocket 50 is shaped as a cat having a cloth print facial portion, ears 52 and 53, and body portion. The pocket is secured to the sleeping bag except along the lower outer edges 55 thereof so that articles may be inserted into the pocket between the inner upper and lower layers thereof 57 and 58. The fastening means or snaps 27 previously described provide a closure along the lower edges 55 of the pocket.

As previously noted, the pocket or pouch is enlarged and must be of sufficient size to create a cavity or space into which the remaining portions of the sleeping bag may be stuffed. Thus, the size of the pocket will depend upon the dimensions of the sleeping bag and the amount and type of materials used for the batting. Additionally, the size of the pocket may be made somewhat larger then necessary to solely accommodate the sleeping bag so that other personal items, such as pajamas, may be selectively stored within the stuffed toy.

With particular reference to FIG. 10, in the preferred embodiment the pocket is uniquely designed and constructed of a plurality of fabric layers. The uppermost layer is the exterior surface portion 59 of the pocket which is, in the preferred embodiment, a cloth print in the configuration of a cat as described. The upper inner surface 57 of the pocket is a cloth print in the configuration of the back of a cat and forms the rear panel 24 of the stuffed toy 20 when the pocket is turned or pulled inside out. Likewise, the lower inner surface 58 of the fabric layers of the pocket is a cloth print in the configuration of the front of a cat and forms the front panel 23 of the stuffed toy 20 when the pocket is turned inside out.

From the foregoing, it is understood that the opposing surfaces of the inner fabric layers 57 and 58 of the pocket form the front and back portions 23 and 24 of the toy 20 so that the toy is a three dimensional resemblance of the cat form or other form created by the upper or exterior surface 59 of the pocket 50. Also shown in FIG. 10 is the handle or strap 40 which is disposed inside the pocket when the invention is utilized as a sleeping bag. It should be noted that the handle 40 is situated between the inner surfaces 57 and 58 of the pocket, and is attached at either end adjacent the closed end of the pocket directly or indirectly to the upper surface of the sleeping bag.

Notwithstanding the foregoing, it is possible to utilize the portion of the top panel 42 of the sleeping bag underlying the pocket's outer or exterior surface portions 59 as the lower inner surface of the pocket which, after the pocket is inverted, becomes either the front or rear panel of the stuffed toy. In such case, the appropriate toy images or characteristics could be printed directly on the underlying cover portion as opposed to having a separate material layer attached thereto.

As noted, the invention may be utilized as a sleeping bag 22, as shown in FIG. 8. As a sleeping bag, the characteristics or objects depicted by the shape of the pocket or a picture or design of such characteristics or objects on the pocket is attractive, stimulating and appealing to a child using the sleeping bag. Additionally, the pocket may be used to store personal items such as glasses, brushes, small toys, pajamas and the like which children may carry with them.

In some instances it may be desired to give the image printed on the pocket a raised relief in order to make the image more pronounced. This may be accomplished by inserting batting between the layers 57 and 59 and thereafter quilting portions of the exterior surface 59.

When it is no longer desired to use the sleeping bag or if the sleeping bag needs to be stored for the day, the sleeping bag can be converted to a stuffed object or toy which may be carried by a child. In converting the sleeping bag into a toy, a parent or child need only insert their hand within the pocket of the sleeping bag and grasp the handle 40. Thereafter, by pulling the handle outwardly of the pocket, the pocket is turned inside out and the remainder of the sleeping bag is initially drawn into the cavity of the inverted pocket. In this manner the inner surfaces of the pocket have been reversed to form the exterior surfaces of the toy with the head or top of the toy attached to the handle as previously described. Once the pocket has been initially inverted, or turned inside out, the remainder of the sleeping bag may be pushed or urged between the front and rear panels of the toy so as to create a stuffing therefor which gives the toy a three dimensional configuration.

As previously noted, as the inner surfaces of the pocket are designed to simulate the front and back portions of the character, animal or other object forming the exterior of the pocket when the invention is used as a sleeping bag, the resultant stuffed toy will resemble, in three dimension, the image conveyed to the child on the pocket. Once all of the sleeping bag has been urged within the cavity formed between the front and rear panels of the toy, the snaps or other closure means along the bottom of the toy are closed thereby retaining the sleeping bag within the cavity of the toy.

In another embodiment of the invention, FIGS. 11–14, the sleeping bag 60, which is similar in construction to the sleeping bag 22 of the preferred embodiment, is shown as being converted into a play toy simulating a knapsack 61. The sleeping bag includes top and bottom panels 62 and 63 which are joined along the sides 64 and 65 and an end 66. As with the preferred embodiment, a zipper or other suitable fastening means may be provided along one or both of the sides and the closed end portion of the sleeping bag.

The upper surface or top panel 62 has an enlarged pocket or pouch 67 attached generally centrally thereto by means of stitching or the like. The pouch 67 is generally rectilinear in configuration and includes an outer surface 68, inner surface 69, a deep pleated or folded bottom wall portion 70 and folded or tucked side walls 71 and 72. Preferably, the inner and outer upper surfaces, bottom and side wall portions are integrally formed. As shown in FIGS. 12 and 13, the bottom and side wall portions include edges 73 which are sewn or otherwise attached to the upper surface 62 of the sleeping bag.

The opening 74 into the pouch is selectively covered by an enlarged flap 75. An eyelet 76 is provided in the flap and a metal or fabric loop 77 is attached to the upper surface of the pouch. A tie cord 78 is secured through the eyelet in the flap and may be used to secure the flap to the loop on the pouch. The flap is sewn or otherwise secured to the upper surface 62 of the sleeping bag as shown at 79.

Although the pouch and flap are shown as being sewn directly to the upper surface of the sleeping bag, an intermediate fabric layer (not shown) could be sewn between the pouch and flap and the upper surface of the sleeping bag in a manner similar to the construction of the preferred embodiment shown in FIG. 10.

A pair of adjustable carrying straps 80 are secured at 81 within the cavity 82 defined by the pouch 67 so as to be in spaced relationship to one another and are attached at each end to the upper surface 62 of the sleeping bag. The straps will be used to permit the sleeping bag to be carried as a toy or play knapsack when the sleeping bag is contained within the pouch.

As in the case with the preferred embodiment, in the present embodiment, when it is desired to put the sleeping bag away, the pouch is pulled inside out from the bottom and the upper and lower panels of the sleeping bag are stored between outer surface 68 of the pouch and the portion of the upper surface of the sleeping bag underlying the pouch. Thus, as the pouch is turned inside out to receive the sleeping bag, the inner surface thereof will become the outer surfaces of a toy which is shaped like a knapsack 61. Further, the carrying straps will now be positioned on the exterior of the toy so that the knapsack may be carried on the shoulders of a child using the knapsack.

When converted to a knapsack the reverse side of the enlarged flap 75 will be facing outward. A second metal or fabric loop 85 is attached to the inner surface 69 of the pouch 67 so that when the pouch is turned inside out the second loop will be disposed on the outside of the knapsack and may selectively receive the tie cord 78. Although not shown, the carrying straps 80 may be removably attached to the upper surface 62 of the sleeping bag.

As previously discussed, the side and bottom walls of the pocket are tucked or pleated to allow for expansion of the pocket so the sleeping bag may be easily contained therein. If the pocket or pouch is constructed somewhat larger than necessary to accommodate the sleeping bag, there will be sufficient space to retain other articles such as sleep wear and other articles or toys and the like when the invention is in the form of a knapsack.

In order to give the knapsack even greater utility for storing or carrying additional articles such as toys, clothes, personal articles and the like, the interior of the pouch may be lined with an additional fabric layer 86. The additional fabric layer, as shown in FIG. 12, has edge portions 87 and 88 and a bottom portion 89 which are sewn or otherwise secured to the edges 73 of the side wall portions and across the inner surface 69 of the pouch. The fabric layer is further sewn as shown at 90 adjacent to the intersection of the side walls 71 and 72 and the inner surface 69 of the pouch thereby creating three separate compartments 91, 92, and 93 which are disposed along the side walls and inner surface 69, respectively. As noted each of the compartments is open along the uppermost edge portion of the fabric layer which is adjacent to the opening into the pouch.

When the pouch is pulled inside out to receive the sleeping bag the compartments or pockets 91, 92, and 93 will be disposed on the exterior surface of the knapsack and may be used to selectively receive articles therein.

I claim:

1. A bedding apparatus which is convertible to a stuffed toy resembling a knapsack comprising a sleeping bag, said sleeping bag having front and rear padded cover portions having inner and outer surfaces, a pouch means attached to one of said outer surfaces of said cover portions so as to define a cavity therebetween, said pouch means having inner and outer surfaces, said pouch means having an opening therein to permit access to said cavity, a pair of strap means disposed within said cavity and attached to said one of said outer surfaces of said cover portions, a flap means attached to said one of said outer surfaces of said cover portions adjacent said opening into said cavity, said cavity being of sufficient size to receive said sleeping bag therein when said pocket is turned inside out, said inner surface of said pouch means forming the outer surface of the knapsack when said pouch is turned inside out so that said strap means is disposed exteriorly of the knapsack, said sleeping bag being receivable within said pouch means so as to thereby give the toy three dimensional characteristics.

2. The invention of claim 1 including at least one pocket means disposed within said cavity and having an opening therein, said pocket means being disposed exteriorly of the knapsack when said pouch is turned inside out.

3. A bedding apparatus which is convertible to a stuffed toy comprising, a sleeping bag having upper and lower padded panel members, each of said panel members having inner and outer surfaces, said upper and lower panel members being extendable into a generally flat configuration, a pocket means having inner and outer surface portions, said pocket means being attached to and oriented exteriorly of one of said outer surfaces of said upper and lower panel members so that said pocket means is located exteriorly thereof when said upper and lower panel members are in a generally flat configuration, said outer surface portion of said pocket means defining a first shape, said inner surface portions of said pocket means defining a first cavity which is spaced exteriorly of said sleeping bag, an opening into said pocket means positioned exteriorly of said outer surfaces of said upper and lower panel members of said sleeping bag when said upper and lower panel members are in a generally flat configuration to permit access into said first cavity, said pocket means being selectively reversible and turned inside out through said opening to thereby form a second cavity defined at least partially by said outer surface portion of said pocket means, said sleeping bag stuffing said second cavity when said pocket means is turned inside out to form a three dimensional stuffed toy, said inner surface portions of said pocket means forming the outer surfaces of the stuffed toy which has a three dimensional shape simulative of said first shape defined by said pocket means.

4. The invention of claim 3 including a first visual image displayed on said outer surface portions of said pocket means, a second visual image displayed on said inner surface portions of said pocket means so that said stuffed toy will have said second visual image displayed on said outer surfaces thereof when said sleeping bag is stuffed within said second cavity, and said first and second visual images relate to a common theme.

5. The invention of claim 4 in which said inner surface portions of said pocket means include first and second opposing layers, one of said first and second layers of said pocket means having said second visual image displayed thereon, said second visual image being generally the same as said first visual image, and the other of said first and second opposing layers of said pocket means having a third image displayed thereon which image is simulated to appear as the back of said second visual image.

6. The invention of claim 3 including closure means located exteriorly of said sleeping bag for selectively closing said pocket means and for alternatively closing said opening to retain said sleeping bag within said second cavity when said pocket means is turned inside out.

7. A bedding apparatus which is convertible to a stuffed toy comprising a sleeping bag having upper and lower surfaces, a pocket means attached to said upper surface of said sleeping bag so as to be positioned exteriorly thereof and in overlaying relationship thereto, said pocket means having inner opposing surface portions and an outer surface portion, a first cavity defined between said inner surface portions of said pocket means, said first cavity being located exteriorly of said upper surface of said sleeping bag, an opening provided in said pocket means to permit access into said first cavity, said opening being located exteriorly of said upper surface of said sleeping bag, said outer surface portion defining a first shape, said pocket means being selectively reversible and turned inside out to form a second cavity of sufficient size to enclose said sleeping bag therein, said pocket means being attached to said upper surface of said sleeping bag so as to cause said sleeping bag to be simultaneously pulled inwardly with respect to said second cavity as said pocket means is turned inside out, said sleeping bag stuffing said second cavity when said pocket means is turned inside out to form a three dimensional stuffed toy, said second cavity having outer surfaces defined by said inner surface portions of said pocket means, whereby when said sleeping bag is stuffed within said second cavity a three dimensional toy is created which appears as said first shape.

* * * * *